US005331906A

United States Patent [19]

Sonoda et al.

[11] Patent Number: 5,331,906

[45] Date of Patent: Jul. 26, 1994

[54] COAL COMBUSTOR AND SLAG EXHAUSTING DEVICE THEREIN

[75] Inventors: Keisuke Sonoda; Yoshinori Kobayashi, both of Nagasaki; Fumiya Nakashima, Tokyo; Kimishiro Tokuda, Nagasaki, all of Japan

[73] Assignee: Mitsubishi Jukogyo Kabushiki Kaisha, Tokyo, Japan

[21] Appl. No.: 54,301

[22] Filed: Apr. 30, 1993

[30] Foreign Application Priority Data

May 1, 1992 [JP] Japan ..... 4-112687

[51] Int. Cl.[5] ..... F23D 1/02

[52] U.S. Cl. ..... 110/264; 110/165 R

[58] Field of Search ..... 110/264, 165 R, 171, 110/347

[56] References Cited

U.S. PATENT DOCUMENTS 3,039,406 6/1962 Aref ..... 110/264
4,473,014 9/1984 Dejanovich ..... 110/264
5,050,512 9/1991 Tratz et al. ..... 110/346

FOREIGN PATENT DOCUMENTS 0241866 10/1987 European Pat. Off. .
1040734 10/1958 Fed. Rep. of Germany .
01287724 1/1969 Fed. Rep. of Germany .
2552077 6/1977 Fed. Rep. of Germany .

*Primary Examiner*—Edward G. Favors
*Attorney, Agent, or Firm*—Wenderoth, Lind & Ponack

[57] ABSTRACT

In order to stably maintain a combustion capability in a combustion furnace for coal gassification, it is necessary to exhaust molten slag produced within the furnace without the slag stagnating. The present invention provides, in a combustion furnace for coal gassification, a slag exhausting device which is configured in such a manner that the cooling of molten slag being exhausted from the furnace is minimized to prevent the slag from solidifying and causing other slag to stagnate. The slag exhausting device is disposed at the center of a bottom wall of the combustor, and has a lower cylindrical portion and an upper bank opening upwardly and flared at an angle of 300°–45°. The height H from the bottom wall to the top of the upper bank, a height L and an inner diameter ds of the cylindrical lower portion and a diameter D of the combustor are set to satisfy the relations of ds/D=0.2–0.4, L/ds=0.2–0.6 and H/D=0.05–0.15.

2 Claims, 5 Drawing Sheets

COAL COMBUSTOR AND SLAG EXHAUSTING DEVICE THEREIN

BACKGROUND OF THE INVENTION

1. Field of the Invention

The present invention relates to a coal combustor applicable to a coal gassification apparatus, a boiler or the like for business use and industrial use and a slag exhausting device therein.

2. Description of the Prior Art

At first, as one example of the prior art, a coal combustor in an entrained bed coal gassification furnace and a slag exhausting device provided at the bottom portion of the coal combustor will be described with reference to FIG. 5.

A slag exhausting device 11 is disposed at the center of the bottom portion of a coal combustor 12. Coal and char, combusted by burners 13 oriented in the circumferential direction of the combustor 12, first produce combustion gas as a result of the combustion, then produce combustible gas as a result of gassification. At the same time an ash content of the coal and char is converted to molten slag, which is centrifugally separated from the gas by a swirling stream 15 flowing from the burners, then adheres to a cylindrical wall surface 4 of the combustor 12 , flows down due to the gravity and accumulates at the bottom portion 16 of the combustor, and finally is exhausted via the slag exhausting device 11 into a slag chamber 17 and towards a slag hopper 18 disposed thereunder.

During this process, in order to facilitate the exhausting of the molten slag 14 through the slag exhausting device 11, it is necessary to maintain the molten slag 14 at a temperature as high as possible.

Although the molten slag 14 is held at a sufficiently high temperature and has a good fluidity (a low viscosity) at the bottom portion 16 of the combustor where the slag is subjected to strong radiation within the combustor 12, on the vertical surface of the slag exhausting device 11 the radiation is weak. Hence the temperature of the molten slag 14 decreases with a consequent loss in fluidity (its viscosity becomes high).

Therefore, as a contrivance for preventing the temperature of the molten slag in the slag exhausting device from decreasing, a bank 19 and a gate 20 around a slag hole as shown in FIG. 5 were adopted.

However, in the case in which a circular hole (slag hole) is open at the center (the central axis CA of the cylindrical combustor) of the bottom portion 16 of the combustor 12 in which a stream is flowing and in which the combustor is connected with a slag chamber 17 thereunder, due to a pressure distribution along the radial direction R within the combustor shown in FIG. 3, a descending flow flowing from the combustor 12 towards the slag chamber 17 is generated at the circumferential wall defining the hole (region A) while an ascending flow flowing from the slag chamber 17 towards the combustor 12 is generated at the central portion of the hole (region B) as shown in FIG. 4. The solid arrow in FIG. 4(*b*) shows the swirling direction of flow within the combustor whereas the dashed arrows show the direction of gas flow within a boundary layer at the bottom of the combustor.

Consequently, high-temperature gas within the combustor 12 descends along the lower surface of slag flowing to the slag hole, and the molten slag is heated by the high-temperature gas.

However, the prior art described above gives rise to the following problems.

(1) At the bottom portion of the combustor 12, molten slag flows out through the gate 20 only, and the bank 19 around the slag hole must be high. The vertical surface defining the slag hole is accordingly high. Hence, little heat radiates to the vertical surface from the combustion region and because the temperature of the slag decreases at the vertical surface, the fluidity of the slag decreases as well.

(2) Furthermore, since increasing the height of the vertical surface defining the slag hole would further block the gas flow at the slag hole portion described above, a flow rate of high-temperature gas flowing from the combustor towards the slag chamber 17 along the circumferential wall portion would correspondingly decrease. Hence, such a measure would also result in the fluidity of the slag decreasing at the slag hole portion.

(3) In the event that the decrease in fluidity of the slag is remarkable, slag would solidify (coagulate) in the slag hole portion, thereby blocking the slag hole and rendering the furnace inoperative.

SUMMARY OF THE INVENTION

It is therefore one object of the present invention to provide an improved coal combustor which is free from the above-described disadvantages in the prior art.

A more specific object of the present invention is to provide an improved slag exhausting device of a coal combustor, in which the above-described various problems in the prior art have been resolved.

According to the present invention, as shown in FIG. 1, while a height H of the slag exhausting device as measured from the bottom wall 5 of the coal combustor is maintained at a necessary value, the upper bank is flared appropriately (at a flare angle $\theta$) to assume an inverse conical shape, and a height of a vertical surface defining the slag hole is relatively short, whereby the amount of heat radiating to the slag hole from a combustion region is sufficiently high.

In addition, according to the present invention, a flow rate of high-temperature gas flowing from a combustor along a wall, at the circumference of a slag hole, and to the outside of the combustor is set at a proper value by establishing the following relationships between parameters (a height H, a flare angle $\theta$ of an upper bank 2, an inner diameter ds of a cylindrical lower portion 3 and a height L of the same cylindrical lower portion 3 as shown in FIG. 1) of the slag exhausting device:

(i) The flare angle $\theta$ of the upper bank 2 of the slag exhausting device is 30°–45°;

(ii) The radio ds/D of the inner diameter ds of the cylindrical lower portion 3 of the slag exhausting device to the inner diameter D of the combustor is 0.2–0.4;

(iii) The ratio L/ds of the height L of the inner cylindrical vertical surface of the cylindrical lower portion 3 to the inner diameter ds of the cylindrical lower portion is 0.2–0.6; and (iv) The ratio H/D of a height H, taken between the upper surface of the bottom wall 5 and the top of the upper bank 2, to the inner diameter D of the combustor is 0.05–0.15.

According to the present invention, owing to the above-described structural features, the following advantages can be obtained.

(1) Molten slag accumulated at the bottom of a combustor is forcibly collected in the slag exhausting device provided at the central axis of the cylindrical peripheral wall of the combustor under the influence of flows at a boundary layer at the bottom of the combustor and smoothly flows into a gate of the upper bank.

(2) The flare angle of the upper bank is properly chosen so that a large an amount of heat radiates to the slag hole from the combustion chamber. Therefore, the amount of heat allowed to dissipate from the molten slag (the slag flowing through the gate and the slag flowing along the inner wall defining the slag hole) is suppressed, and accordingly, a lowering of the temperature of the slag is suppressed.

(3) The height H, and the height L and diameter ds of the cylindrical lower portion are properly chosen so that a part of the high-temperature gas within the combustor flows into the slag hole jointly with the molten slag and flows out of the combustor. Therefore, the molten slag is heated and a lowering of the temperature of the slag can be suppressed.

In addition, as a result of the above-mentioned advantages of the slag exhausting device, improvements in the reliability of the coal combustor can be achieved.

The above-mentioned and other objects, features and advantages of the present invention will become more apparent by referring to the following detailed description of the preferred embodiment of the invention taken in conjunction with the accompanying drawings.

DETAILED DESCRIPTION OF THE DRAWINGS

Figure 1:
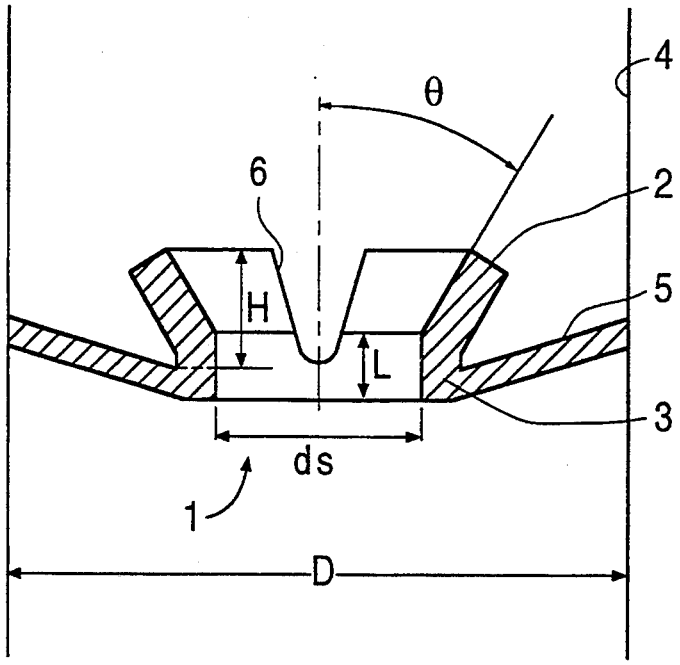
Figure 2A:
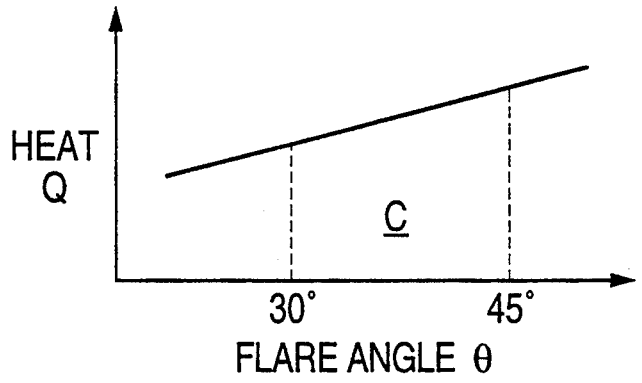
Figure 2B:
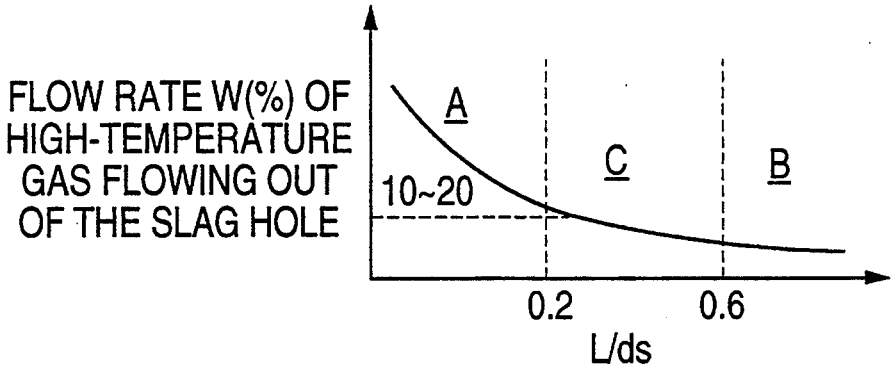
Figure 2C:
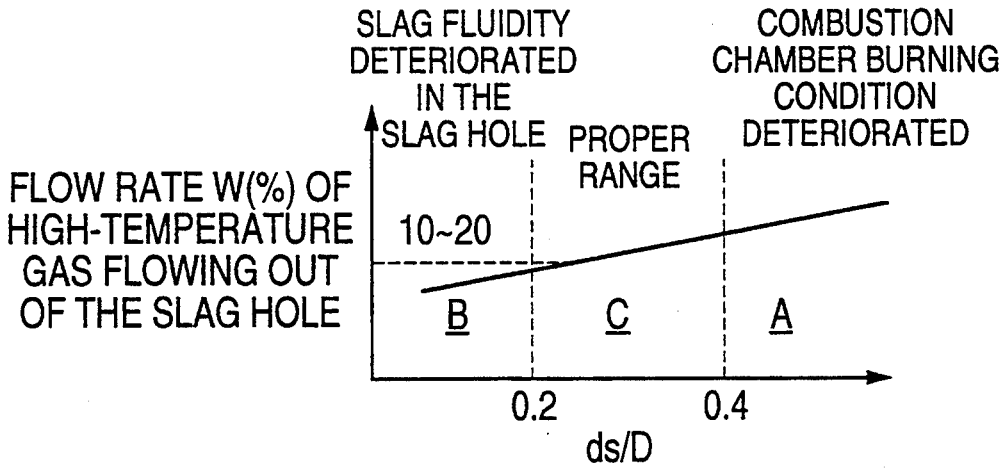
Figure 3A:
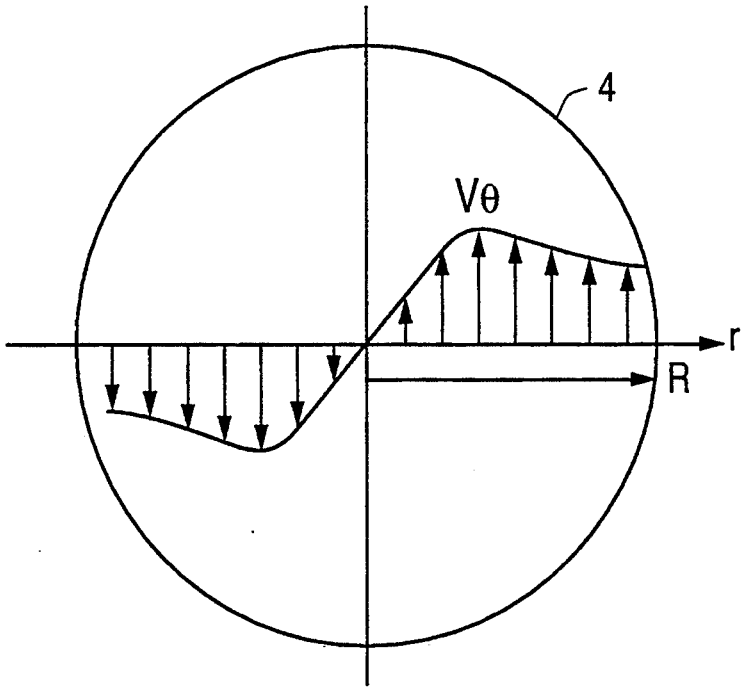
Figure 3B:
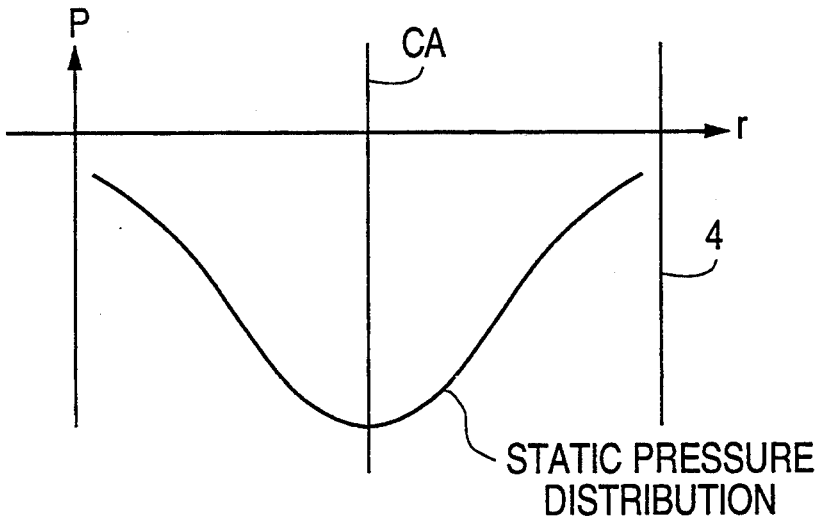
Figure 4A:
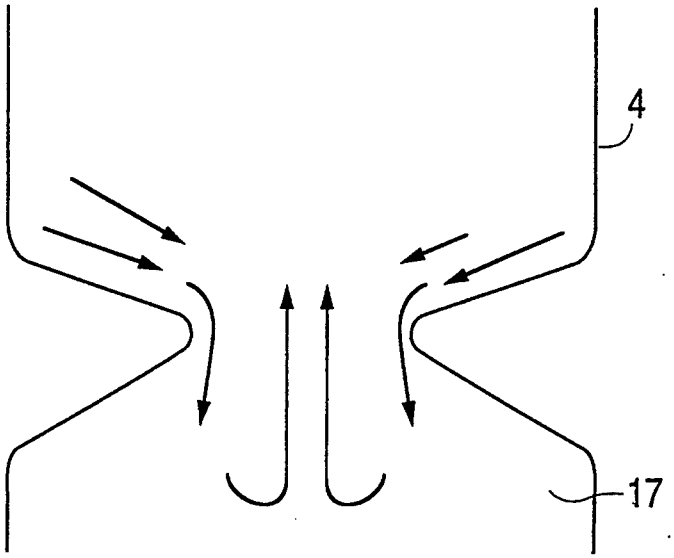
FIG. 4(a) PRIOR ART
Figure 4B:
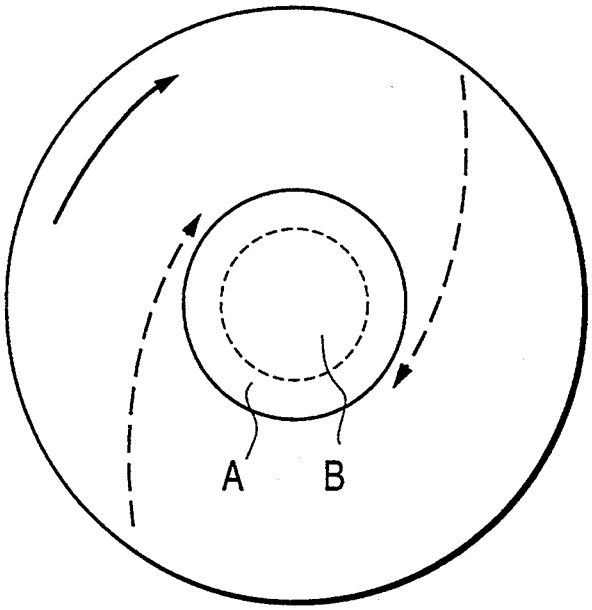
FIG. 4(b) PRIOR ART
Figure 5A:
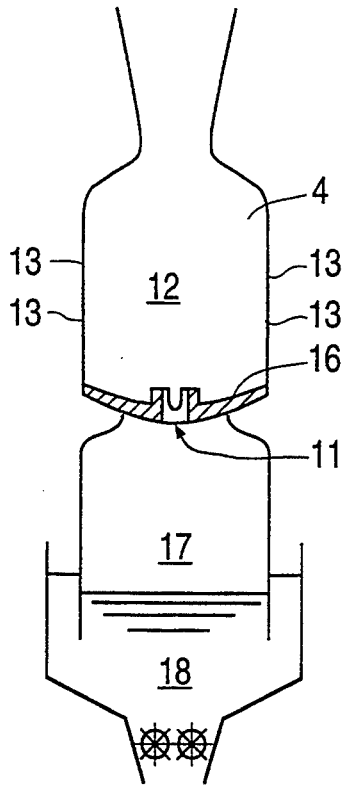
FIG. 5(a) PRIOR ART
Figure 5B:
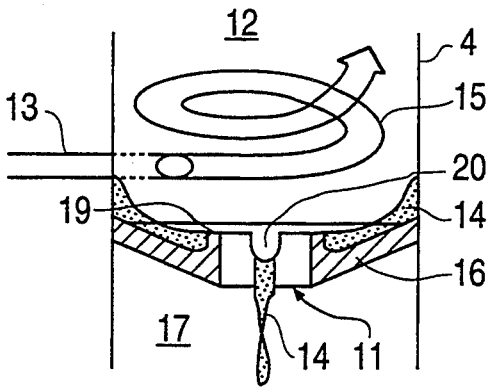
FIG. 5(b) PRIOR ART
Figure 5C:
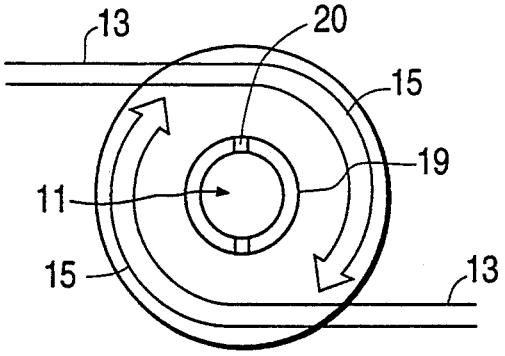
FIG. 5(c) PRIOR ART

In the accompanying drawings:

FIG. 1 is a schematic view of one embodiment of a slag exhausting device in a coal combustor according to the present invention;

FIGS. 2(*a*)–2(*c*) are diagrams showing relationships among a radiation heat amount Q, a high-temperature gas flow rate W and various parameters in the slag exhausting device according to the present invention;

FIGS. 3(*a*) and 3(*b*) are diagrams showing a swirl velocity distribution $V\theta$ and a static pressure distribution P in a combustor, respectively;

FIGS. 4(*a*) and 4(*b*) are schematic diagrams showing gas flows at the bottom portion of a combustor and in slag hole of the combustor; and FIGS. 5(*a*)–5(*c*) are schematic diagrams of an entrained bed coal gassification furnace in the prior art.

DETAILED DESCRIPTION OF THE PREFERRED EMBODIMENT

At first, the operating principle of the present invention will be described. As shown in FIG. 2(*a*), an amount of heat Q radiating into the slag hole increases as the flare angle $\theta$ of the upper bank 2 (FIG. 1) of the slag exhausting device becomes larger. In addition, a flow rate W of the high-temperature gas flowing out of the combustor through the slag hole to a slag chamber outside of the combustor becomes larger (FIG. 2 (*b*)) as the flare angle of the upper bank 2 of the slag exhausting device becomes larger, as the height L of the cylindrical lower portion 3 of the slag exhausting device becomes lower, and further as the diameter ds of the cylindrical lower portion 3 becomes larger. These relations can be expressed by the following mathematical formulae:

$$Q \propto \theta$$

$$W \propto ds/D$$

$$W \propto ds/L$$

However, if the flare angle $\theta$ is too small (under 30°), the amount of heat radiating to the bottom portion of the combustor is insufficient, and so, the fluidity of the molten slag is correspondingly reduced at the bottom portion of the combustor. If the flare angle $\theta$ is excessive (more than 45°), the upper block 2 prevents heat from radiating to a portion surrounding the slag hole and again, the fluidity of slag at the bottom of the combustion chamber is insufficiently maintained. Also, if the flow rate of the high-temperature gas is excessive (regions A in FIGS. 2(*b*) and 2(*c*)), as occurs when L/ds is less than 0.2 or ds/D is greater than 0.4, the environment for combustion is adversely influenced by the low-temperature gas flowing into the combustor from the slag chamber outside the combustor. On the other hand, when there is an insufficient flow rate, as occurs when L/ds is greater than 0.6 or ds/D is less than 0.4, the fluidity of slag in the slag hole is insufficient (regions B).

Furthermore, dispersion of molten slag at the outlet of the slag hole ordinarily would create harmful effects such as the slag adhering to the wall of an outer vessel of the combustor and solidifying there.

In addition, with regard to the ratio H/D of the height H of the upper bank 2 to the diameter D of the combustor, in the case where H/D is 0.05 or less, a slag dam-up volume of the bank is small. Therefore, slag would flow to the slag hole not only through the gate but over the bank as well. Thus, the molten slag would be dispersed at the outlet of the slag hole.

If the ratio H/D is 0.15 or more, at the bottom portion of the furnace an area of the inclined portion of the upper bank projected onto the slag hole is large. Hence heat within the furnace hardly radiates to this area, and molten slag would solidify there giving rise to harmful effects such as inhibiting the flow of slag at the bottom portion of the furnace.

Therefore, the flare angle $\theta$ of the upper bank 2, the diameter ds of the cylindrical lower portion 3 and the height L of a vertical surface of the cylindrical lower portion 3 are set at proper values. According to the present invention, proper values of the angle $\theta$, the ratio L/ds and the ratio ds/D fall within the regions C shown in the diagrams of FIG. 2. With these values implemented, fluidity of the slag at the slag exhausting device is enhanced without adversely affecting the combustor, whereby slag can be smoothly exhausted by the slag exhausting device.

One preferred embodiment of the present invention as applied to a pressurized entrained bed coal gassification furnace is disclosed in the following. A general configuration of the slag exhausting device is similar to that shown in FIG. 1, and when the following conditions were employed, slag could be exhausted smoothly from the slag exhausting device:

| | | |
|---|---|---|
| i) | a flare angle of the tip end portion of the slag hole | $\theta = 30°$ |
| ii) | a ratio of a slag hole diameter to a | ds/D = 0.25 |

-continued

| | | |
|---|---|---|
| | combustor diameter | |
| iii) | a ratio of the height of a vertical surface defining the slag hole to the diameter of the slag hole | L/ds = 0.5 |
| iv) | a ratio of the height of a slag hole bank to a combustor diameter | H/D = 0.15 |

While a principle of the present invention has been described above in connection with one preferred embodiment of the invention, it is intended that all matter contained in the above description and illustrated in the accompanying drawings be interpreted as illustrative and not as a limitation on the scope of the invention.

What is claimed is:

1. In a coal combustor in which coal is burnt while swirling, and an ash content of the coal is blown against a peripheral wall of a combustion chamber of the combustor due to centrifugal forces and drops to a bottom wall of the combustion chamber, a slag exhausting device disposed at the bottom wall of the combustion chamber, said slag exhausting device comprising: a cylindrical lower portion extending from the bottom wall of the combustion chamber and defining a slag opening therethrough, and an upper bank flaring outwardly from an upper end of said cylindrical lower portion, said upper bank flaring outwardly from said cylindrical lower portion at a flare angle of 30°–45°, a ratio of the inner diameter of the cylindrical lower portion to the inner diameter of the peripheral wall of the combustion chamber being 0.2–0.4, a ratio of the height of an inner cylindrical vertical wall of said cylindrical lower portion to the inner diameter of said cylindrical lower portion being 0.2–0.6, and a ratio of a height in the slag exhausting device, taken from where an upper surface of the bottom wall of the combustion chamber intersects said cylindrical lower portion to the top of the upper bank, to the diameter of the peripheral wall of the combustion chamber being 0.05–0.15.

2. A slag exhausting device disposed at the center of the bottom wall of a coal combustion furnace said device comprising: a cylindrical lower portion extending from the bottom wall of the furnace, and an upper bank flaring outwardly from an upper end of said cylindrical lower portion, said bank having a gate extending downwards therethrough from its top edge, said upper bank flaring outwardly from said cylindrical lower portion at a flare angle of 30°–45°, a ratio of the inner diameter of the cylindrical lower portion to the inner diameter of the combustion furnace being 0.2–0.4, a ratio of the height of an inner cylindrical vertical wall of said cylindrical lower portion to the inner diameter of said cylindrical lower portion being 0.2–0.6, and a ratio of a height in the slag exhausting device, taken from where an upper surface of the bottom wall of the furnace intersects said cylindrical lower portion to the top of the upper bank, to the inner diameter of the combustion furnace being 0.05–0.15.

* * * * *